US006079748A

United States Patent [19]

Kaufman

[11] Patent Number: 6,079,748

[45] Date of Patent: Jun. 27, 2000

[54] BOOK WITH STORAGE FOR MANIPULATIVES

[75] Inventor: Shari Kaufman, Westport, Conn.

[73] Assignee: Innovative USA, Inc., Stamford, Conn.

[21] Appl. No.: 09/138,878

[22] Filed: Aug. 24, 1998

[51] Int. Cl.[7] ..... B42D 1/08

[52] U.S. Cl. ..... 281/22; 281/29; 281/31; 402/4; 446/73; 446/75; 446/147

[58] Field of Search ..... 281/22, 28, 29, 281/31, 33, 37, 51; 402/4; 446/73, 75, 147

[56] References Cited

U.S. PATENT DOCUMENTS

| | | | |
|---|---|---|---|
| 401,382 | 4/1889 | Seely | 281/51 |
| 1,145,848 | 7/1915 | Robins | 281/51 |
| 3,298,374 | 1/1967 | Grundell | 402/4 |
| 3,813,075 | 5/1974 | Capper | 248/461 |
| 4,176,473 | 12/1979 | Rae | 35/35 E |
| 4,365,438 | 12/1982 | Nelson | 46/202 |
| 4,652,034 | 3/1987 | Crowther | 294/138 |
| 4,743,047 | 5/1988 | Baer | 281/22 |
| 5,338,125 | 8/1994 | Forsse et al. | 402/46 |
| 5,575,505 | 11/1996 | Bridges | 281/36 |
| 5,584,387 | 12/1996 | Grant | 206/216 |
| 5,678,943 | 10/1997 | Parsons | 402/4 |
| 5,681,199 | 10/1997 | Morris | 281/51 |
| 5,683,111 | 11/1997 | Bass et al. | 281/21.1 |
| 5,695,294 | 12/1997 | Bedol et al. | 402/79 |
| 5,713,553 | 2/1998 | Copper | 248/461 |
| 5,915,729 | 6/1999 | Vap | 281/22 |

*Primary Examiner*—Andrea L. Pitts
*Assistant Examiner*—Monica Smith Carter
*Attorney, Agent, or Firm*—Hedman, Gibson & Costigan, P.C.

[57] ABSTRACT

A book having a storage tube attached thereto for storage of manipulatives for use with enjoyment of the book is disclosed.

3 Claims, 1 Drawing Sheet

BOOK WITH STORAGE FOR MANIPULATIVES

The present invention relates to a book which is useful with manipulative pieces. Manipulative pieces are typically interactive game or learning pieces which are useful n working directly with the book. More particularly, the present invention is related to a book which is provided with a storage space for storing the manipulative pieces. Most particularly, the present invention is related to a book having a tubular construction attached to the outside of the book which is sealable to contain manipulatives useful in the enjoyment of the book or can also contain a candy or other object which works directly with the book or not with the book.

BACKGROUND OF THE INVENTION

A variety of books are currently on the market which are provided with manipulative pieces or game pieces for use with the book. These types of books especially have a high degree of educational and/or entertainment value for children. For instance, a certain variety of books have manipulative pieces which may be placed on the page to complete a picture. In other books, a number of to manipulative pieces need to be placed adjacent to each other in order to complete a picture.

The general concept of attaching the associated manipulatives to the books or other printed matter such as magazines and albums is well known. One method is to attach the manipulatives to the cover of the book with a pressure sensitive adhesive whereby the consumer can peel of the manipulative from the book. In U.S. Pat. Nos. 5,301,803 and 5,303,825, both Hansen et al., cassettes are attached to printed sheets.

However, in these types of embodiments there is always the risk that because of the attachment method the cover of the book may become permanently defaced. Further, when a larger number of manipulatives are attached, the likelihood of defacement becomes even more acute.

In Grant, U.S. Pat. No. 5,584,387 there is disclosed a combination book and package case assembly wherein the package case for containing the manipulatives is attached to a spiral binding by means of a hinge strip onto which the package case may be attached. However, this type of embodiment is severely limited to manipulatives which are relatively flat.

Accordingly, it would represent an advancement in the art of attaching manipulatives to books if a means of attachment were provided which overcame all of the above-noted drawbacks of the prior art. Also it would represent an advancement in the state of the art if a book with an improved means for containing the manipulatives or other objects was provided which was especially suitable as a travel book. Mention here is also made of Bedol et al., U.S. Pat. No. 5,695,294 which describes an attachment means to a spiral notebook to assist in employing the volume formed by the spiral rings as a storage space.

SUMMARY OF THE PRESENT INVENTION

It is an object of the present invention to provide a book which can be employed with manipulative pieces.

It is another object of the present invention to provide a book having a storage means for storing the manipulative pieces to be used with the book.

It is a further object of the present invention to provide a book with a storage means which enhances the marketability of the book.

It is still another object of the present to provide a book which has a manipulatives storage means which provides easy access to remove and replace the manipulatives without defacing the book.

It is a still further object of the present invention to provide a book having a manipulatives storage means which will lay flat on a planar surface and which facilitates stacking of the books.

It is another further object of the present invention to provide a book with a manipulative storage means which can shelve spine out and can further provide advertising copy and/or title information on the spine, and/or a visually aesthetic spine.

Accordingly, these objects and others are achieved by the book of the present invention which comprises a front cover; a back cover; at least one page between the front and back covers; a storage tube; and a means for attaching a tube to said back or front cover wherein an object may be stored in the tube. Preferably the object comprises at least one manipulative piece, but may also comprise a liquid, or other object, including a candy.

In preferred embodiments the manipulatives are suitable for use with or related to the theme of the book. It is also contemplated herein that the tube be of a cylindrical or parallelepiped construction and relatively transparent such that the manipulative may be seen through the tube.

DETAILED DESCRIPTION OF THE PRESENT INVENTION AND DESCRIPTION OF THE PREFERRED EMBODIMENTS

The following description of preferred embodiments is presented to illustrate the present invention and is not to be construed to limit the scope of the appended claims in any manner whatsoever.

Figure 1:
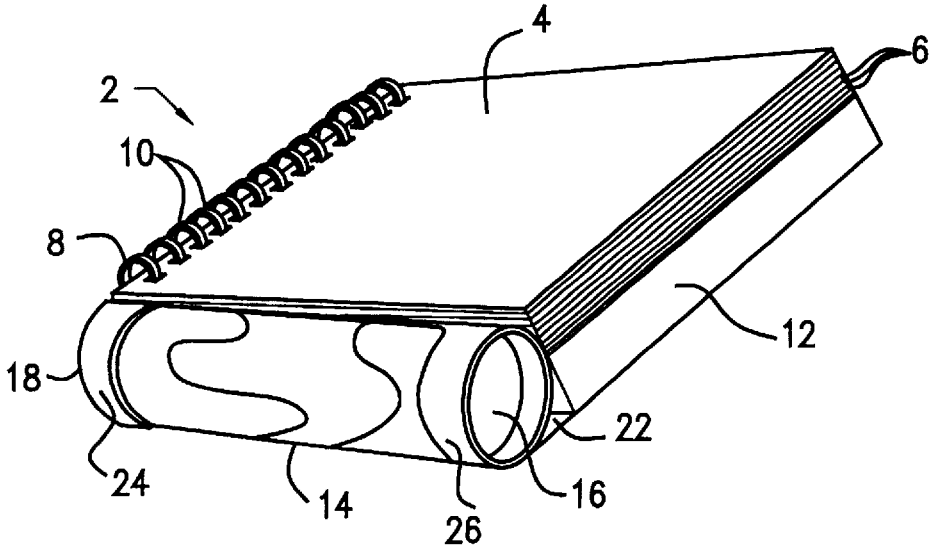
FIG. 1 depicts a top view of an embodiment of the present invention wherein the book is in a closed position.

Referring to FIG. 1, there is shown a top view of a book of the present invention. The book 2 has a front cover 4 and a plurality of pages 6 which are bound together with a spiral binding 8 through cut outs 10. The front cover 4 may be constructed of any material known to those skilled in the art which provides sufficient rigidity and printability. These materials may include but are not limited to paper, cardboard, textiles and plastics. Preferred is cardboard ranging from about 1/32 to about 3/32 of an inch thick. Especially preferred is cardboard which is about 1/16 of an inch thick.

In embodiments where the tube is located on an unbound side of the book, the binding of the book may be effected by any of the well known conventional means, i.e. by binding, gluing, stitching, with a saddle wire or with a spiral wire or other material wound through a multitude of holes punched through the pages. These and other types of bindings are well known to those of ordinary skill in the art. The embodiment of FIG. 1 shows the use of a spiral bound book.

Also attached to the spiral binding 8 is a back cover 12 onto which is attached a tube 14. The tube 14 may take any of a variety of convenient shapes suitable for containing the manipulatives. For example, the tube may be cylindrical, or polyhedronic such as parallelepiped, right parallelepiped or having a triangular cross section. However, a substantially cylindrical tube is preferred. The tube 14 may be transparent, colored or non-transparent as desired. In order to provide a better viewing of the manipulatives a transparent clear or transparent colored tube is typically employed. The ends of the tube are fitted with a sealing means such as plugs or caps 16 and 18 at least one of which is removable and reinsertable. Of course other types of sealing means may be employed which provide ingress into and egress out of the tube for the manipulatives, such as a hinged door type cap. The caps 16 and 18 serve to contain the manipulatives within the tube. The caps 16 and/or 18 may be provided with means to assist in their opening and closing, such as a handle. One of the caps 16 or 18 may be sealed so as not to open to provide a more secure containment of the manipulatives where desired.

The back page 12 may be constructed of any material known to those skilled in the art which provides sufficient rigidity and printability and is suitable for having the tube attached thereto. These materials may include but are not limited to paper, cardboard, textiles and plastics. For example, cardboard which is at least 1/32 of an inch thick may generally be employed.

In preferred embodiments of the present invention, it is contemplated that the combined thickness of the front cover, interior pages and back cover be approximately equal to the height of the tube (or diameter of the cylindrical tube) in order to provide a book which will lay flat on a planar surface, such as a table top or desk top, and to facilitate stacking of the books. Accordingly, the thickness of the back cover 12 may be adjusted to make up the difference between the height of the tube (or diameter of the cylindrical tube) and the front cover and interior page combined thickness.

Figure 2:
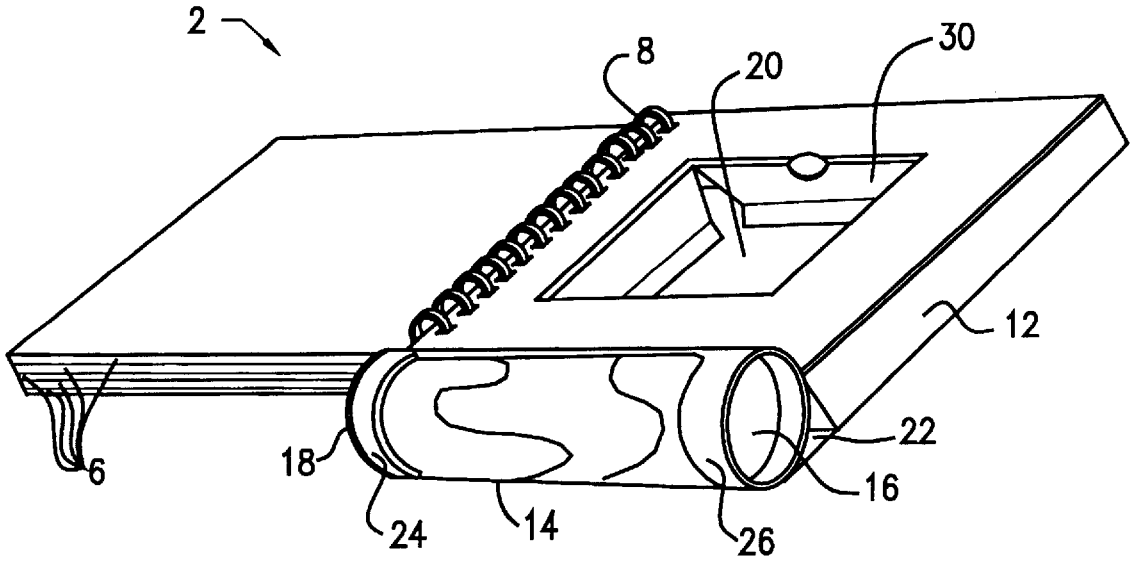
FIG. 2 depicts a top view of an embodiment of the present invention wherein the book is in an open position.

As seen in FIGS. 1 and 2, the back cover 12 has a considerable thickness compared to the front cover and the interior pages. In embodiments having a substantially thick back cover, it is further contemplated that the back cover be of a hollow box like construction, into which may be formed a storage chamber 20, which may be employed to store additional manipulatives, or a game board for use with the manipulatives. The storage space may be provided by use of fold-in flaps 30 as seen in FIG. 2. Alternatively, the back cover 12 may be hollow and provided with a removeable tray which can optionally be equipped with a transparent window, such as a sheet of acetate, through which the additional manipulatives may be viewed. In either embodiment wherein a storage space is provided, the back side of the back cover 12 may be provided with a see through window so that prospective customers can view the contents. Also the storage chamber 20 may be provided with an audio cassette which tells the story of the book or provides music related to the book, a video cassette movie of the book, or with a computer diskette or CD-ROM computer disk which likewise contains information associated with the book.

The tube 14 may be attached to the book in a variety of ways. In an especially preferred embodiment, as shown in FIGS. 1 and 2, the tube is attached to the back cover 12 with a sheet of paper or plastic or cloth 22 having one end which is adhered to the bottom side of the back cover 12. The sheet 22 then wraps around the tube 14 and the other end is adhered to the side of the back cover. In another preferred embodiment, where a transparent tube 14 is employed, the sheet 22 may have a window therein such that the portions of the sheet which wrap around the tube 14 comprise end strips 24 and 26. The sheet can be printed on to further enhance the marketability of the book.

It is noted that the manner of adhering the tube to the book is not critical to the present invention and any means of adhering may be employed without departing from the spirit of the claimed invention. FIG. 1 merely shows one embodiment, and other adhering embodiments will be readily apparent to those of ordinary skill in the art.

Further, it is contemplated that the tube may function as part of the spine of the book. In this type of embodiment the pages would have a slot through which the tube would pass. In this manner the tube would serve as a binder for the pages of the book.

Many variations of the present invention will suggest themselves to those skilled in the art in light of the above-detailed description. For example, the tube may be clear and may be constructed of a wide variety of materials, or the tube may be transparent and colored. The manipulatives for use with the present invention may comprise small plastic figures, small stuffed animals, game pieces and the like. All such obvious modifications are within the full intended scope of the appended claims.

What is claimed is:

1. A book having a storage means for storing manipulatives, said book comprising:

a front cover;

a back cover;

optionally, at least one page between said front and back covers;

said front cover, back cover and at least one optional page being attached alone one side to form a spine of said book;

a storage tube having two capped ends;

a means for attaching said tube to said book wherein an object may be stored in said tube;

wherein said tube is attached at least in part to said back cover and is attached to said book along a side which is not the spine;

wherein said means of attaching the tube to said back cover comprises a sheet of paper which extends around the tube; and wherein said tube is transparent and said sheet of paper extends around the ends of the tube thereby defining a central transparent portion in the tube.

2. A book having a storage means for storing manipulatives, said book comprising:

a front cover;

a back cover having a storage space for storing an object;

optionally, at least one page between said front and back covers;

said front cover, back cover and at least one optional page being attached along one side to form a spine of said book;

a storage tube having two capped ends;

a means for attaching said tube to said book wherein an object may be stored in said tube;

wherein said tube is attached at least in part to said back cover;

wherein said back cover is hollow and said back cover has an inner surface which comprises fold in flaps which when folded inward form said storage space.

3. A book as defined in claim 2 wherein said back cover has an outer surface which is provided with a transparent window.

* * * * *